US011353031B1

(12) United States Patent
Chou

(10) Patent No.: US 11,353,031 B1
(45) Date of Patent: Jun. 7, 2022

(54) SERIES FAN

(71) Applicant: ASIA VITAL COMPONENTS CO., LTD., New Taipei (TW)

(72) Inventor: Chu-Hsien Chou, New Taipei (TW)

(73) Assignee: Asia Vital Components Co., Ltd., New Taipei (TW)

( * ) Notice: Subject to any disclaimer, the term of this patent is extended or adjusted under 35 U.S.C. 154(b) by 0 days.

(21) Appl. No.: 17/361,330

(22) Filed: Jun. 29, 2021

(51) Int. Cl.

| | |
|---|---|
| ***F04D 19/00*** | (2006.01) |
| ***F04D 25/16*** | (2006.01) |
| ***F04D 29/36*** | (2006.01) |
| ***F04D 29/32*** | (2006.01) |
| ***F04D 29/60*** | (2006.01) |

(52) U.S. Cl.
CPC ..... *F04D 19/007* (2013.01); *F04D 19/002* (2013.01); *F04D 25/166* (2013.01); *F04D 29/325* (2013.01); *F04D 29/36* (2013.01); *F04D 29/601* (2013.01)

(58) Field of Classification Search
CPC .... F04D 19/007; F04D 19/002; F04D 25/166; F04D 29/325; F04D 29/36; F04D 29/601
See application file for complete search history.

(56) References Cited

U.S. PATENT DOCUMENTS

| | | | |
|---|---|---|---|
| 2004/0219022 A1 | 11/2004 | Yang | |
| 2015/0226222 A1 | 8/2015 | Chou et al. | |
| 2015/0226230 A1* | 8/2015 | Chang | F04D 19/007 415/200 |

FOREIGN PATENT DOCUMENTS

| | | |
|---|---|---|
| EP | 3708842 A1 | 9/2020 |
| JP | 2-264200 A | 10/1990 |
| JP | 5610008 B2 | 10/2014 |
| TW | 570493 | 1/2004 |
| TW | M477508 | 5/2014 |
| TW | M617451 | 9/2021 |
| WO | 2021/033244 A1 | 2/2021 |

OTHER PUBLICATIONS

Search Report dated Mar. 31, 2022 issued by Taiwan Intellectual Property Office for counterpart application No. 110121019.
Search Report dated Mar. 9, 2022 issued by European Patent Office for counterpart application No. 21182683.9.

* cited by examiner

*Primary Examiner* — Aaron R Eastman
(74) *Attorney, Agent, or Firm* — Bradley J. Thorson; DeWitt LLP

(57) ABSTRACT

A series fan includes a first fan and a second fan. The first fan includes a first frame body with a wind incoming side and a connection side at two sides, a first dynamic blade impeller and a first shaft seat. The first dynamic blade impeller is pivotally disposed on the first shaft seat and has first dynamic blades. The second fan includes a second frame body, a second dynamic blade impeller and a second shaft seat. Two sides of the second frame body are formed with a wind outgoing side and a mating side mated with the connection side in communication therewith. The second dynamic blade impeller is pivotally disposed on the second shaft seat and has second dynamic blades. At least one connected section of the second dynamic blade is integrally connected with at least one connection section of the first dynamic blade to form a driving blade.

10 Claims, 4 Drawing Sheets

SERIES FAN

BACKGROUND OF THE INVENTION

1. Field of the Invention

The present invention relates generally to a series fan, and more particularly to a series fan in which two dynamic blades are connected to form a driving blade in the form of a continuous blade so as to enhance the wind pressure of the series fan.

2. Description of the Related Art

Along with the advance of sciences and technologies, the reliance of peoples on various electronic devices has been more and more increased. However, in operation, the internal components of the electronic devices (such as computers and notebooks) will generate high heat. The heat must be conducted out of the electronic devices in time. Otherwise, the internal components will be over-heated. Therefore, in most of the electronic devices, a cooling fan is often employed to actively dissipate the heat so as to keep the electronic products working within a certain operation temperature range. However, sometimes one single cooling fan can hardly provide sufficient wind force. Therefore, two or more fans are often serially assembled to form a series fan so as to provide sufficient wind force.

In a conventional series fan, a front fan and a rear fan are serially connected. The main components of the series fan include pre-dynamic blades, pre-static blades, post-static blades and post-dynamic blades, which are sequentially arranged from the wind incoming opening to the wind outgoing opening. The pre-static blades of the front fan and the post-static blades of the rear fan serve as best support components for the series fan. However, the pre-static blades of the front fan and the post-static blades of the rear fan are positioned in the middle of the series fan. Therefore, the structural supportability of the series fan in the position of the pre-dynamic blades of the front fan and the post-dynamic blades of the rear fan is relatively weak. That is, the structural supportability of the series fan at the wind incoming opening and the wind outgoing opening is weaker.

When the conventional series fan is fixed in the electronic device, the electronic device is assembled with the wind incoming opening or wind outgoing opening of the series fan. However, the pre-dynamic blades and the post-dynamic blades at the wind incoming opening and the wind outgoing opening are not supported by any support structure. In this case, the vibration value of the entire series fan is often increased to affect the stability of the system of the entire series fan.

Moreover, the pre-dynamic blades and the post-dynamic blades at the wind incoming opening and the wind outgoing opening are in an open state. In consideration of security, a protection web is often additionally mounted in the positions of the wind incoming opening and the wind outgoing opening of the series fan to achieve protection effect. This causes increase of cost of material and working time of the entire series fan.

Furthermore, when the conventional series fan is disposed in the electronic device, the corresponding installation height of the series fan is fixed and limited. Therefore, the total thickness of the series fan is limited. That is, the design of the dynamic and static blades of the series fan is limited by the arrangement of the middle motors and the pre-dynamic blades and the post-dynamic blades of the front and rear fans so that the total height and size of the series fan are designed in a fixed proportion. Relatively, the pre-dynamic blades and the post-dynamic blades have fixed sizes and proportions. In addition, the pre-dynamic blades and the post-dynamic blades are limited by the fixed sizes and arrangement of the intermediate components, (that is, the pre-static blades and the post-static blades) so that the pre-dynamic blades and the post-dynamic blades can only independently rotate as two separate components and cannot be made in the form of one single continuous blade. As a result, when the pre-dynamic blades and the post-dynamic blades with fixed sizes respectively pressurize the airflow flowing into the series fan, before the airflow is pressurized, the airflow is thrown out by the respective blades, (that is, the pre-dynamic blades and the post-dynamic blades). Therefore, the pressurizing time of the pre-dynamic blades and the post-dynamic blades for the airflow flowing into the series fan is too short so that the wind pressure of the entire series fan cannot be effectively enhanced.

SUMMARY OF THE INVENTION

It is therefore a primary object of the present invention to provide a series fan, which has enhanced wind pressure effect.

To achieve the above and other objects, the series fan of the present invention includes a first fan and a second fan. The first fan includes a first frame body, a first dynamic blade impeller and a first shaft seat. Two sides of the first frame body are respectively formed with a wind incoming side and a connection side. The first shaft seat is disposed at a center of the wind incoming side. A first static blade is disposed between the first shaft seat and inner circumference of the first frame body. The first dynamic blade impeller is pivotally disposed on the first shaft seat and has multiple first dynamic blades. Each first dynamic blade has at least one connection section. The second fan includes a second frame body, a second dynamic blade impeller and a second shaft seat. Two sides of the second frame body are respectively formed with a wind outgoing side and a mating side mated with the connection side in communication therewith. The second shaft seat is disposed at a center of the wind outgoing side. A second static blade is disposed between the second shaft seat and inner circumference of the second frame body. The second dynamic blade impeller is pivotally disposed on the second shaft seat and has multiple second dynamic blades. Each second dynamic blade has at least one connected section. The connected section of the second dynamic blade is integrally connected with the connection section of the first dynamic blade to form a driving blade. The first fan is upside-down placed and serially connected with the second fan. By means of the above design of the series fan of the present invention, the wind pressure of the entire series fan is effectively enhanced.

In the above series fan, the connection side has a first opening. The first dynamic blade impeller has a first hub and a first shaft. One end of the first shaft is fixedly disposed at a center of the first hub. The other end of the first shaft is pivotally disposed in the first shaft seat. The multiple first dynamic blades are radially disposed along outer circumference of the first hub. Each first dynamic blade has a blade front edge and a blade tail edge. The connection section is disposed on the blade front edge. The blade front edge is protruded from, recessed into or flush with the first opening. The blade tail edge is positioned in the wind incoming side.

In the above series fan, the mating side has a second opening in communication with the first opening. The second dynamic blade impeller has a second hub and a second shaft. One end of the second shaft is fixedly disposed at a center of the second hub. The other end of the second shaft is pivotally disposed in the second shaft seat. The multiple second dynamic blades are radially disposed along outer circumference of the second hub. Each second dynamic blade has a blade front edge and a blade tail edge. The connected section is disposed on the blade front edge of the second dynamic blade. The blade front edge of the second dynamic blade is protruded from the second opening into the first opening, flush with the second opening or recessed into the second opening. The blade tail edge of the second dynamic blade is positioned in the wind outgoing side.

In the above series fan, each first dynamic blade has a first upper surface and a first lower surface and each second dynamic blade has a second upper surface and a second lower surface. The first upper surface is connected with the second upper surface to form a continuous upper surface. The first lower surface is connected with the second lower surface to form a continuous lower surface.

In the above series fan, the connection section and the connected section are raised structure and recessed structure in adaptation to the raised structure or any other connection structures in adaptation to each other, such as recessed structure and raised structure in adaptation to the recessed structure, screw structures, insertion structures, adhesion structures or welding structures.

In the above series fan, the connection side of the first frame body is mated with the mating side of the second frame body by means of engagement, locking, insertion, adhesion, slide rail or latching.

In the above series fan, the connection side has a first opening. A first flow way is defined between the wind incoming side and the first opening. The first flow way is in communication with the wind incoming side and the first opening.

In the above series fan, the mating side has a second opening in communication with the first opening. A second flow way is defined between the wind outgoing side and the second opening. The second flow way is in communication with the wind outgoing side and the second opening. The first and second flow ways are in communication with each other to together form an airflow guide passage. The driving blade is positioned in the airflow guide passage.

In the above series fan, the first dynamic blade impeller and the second dynamic blade impeller are formed by means of integral injection molding.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
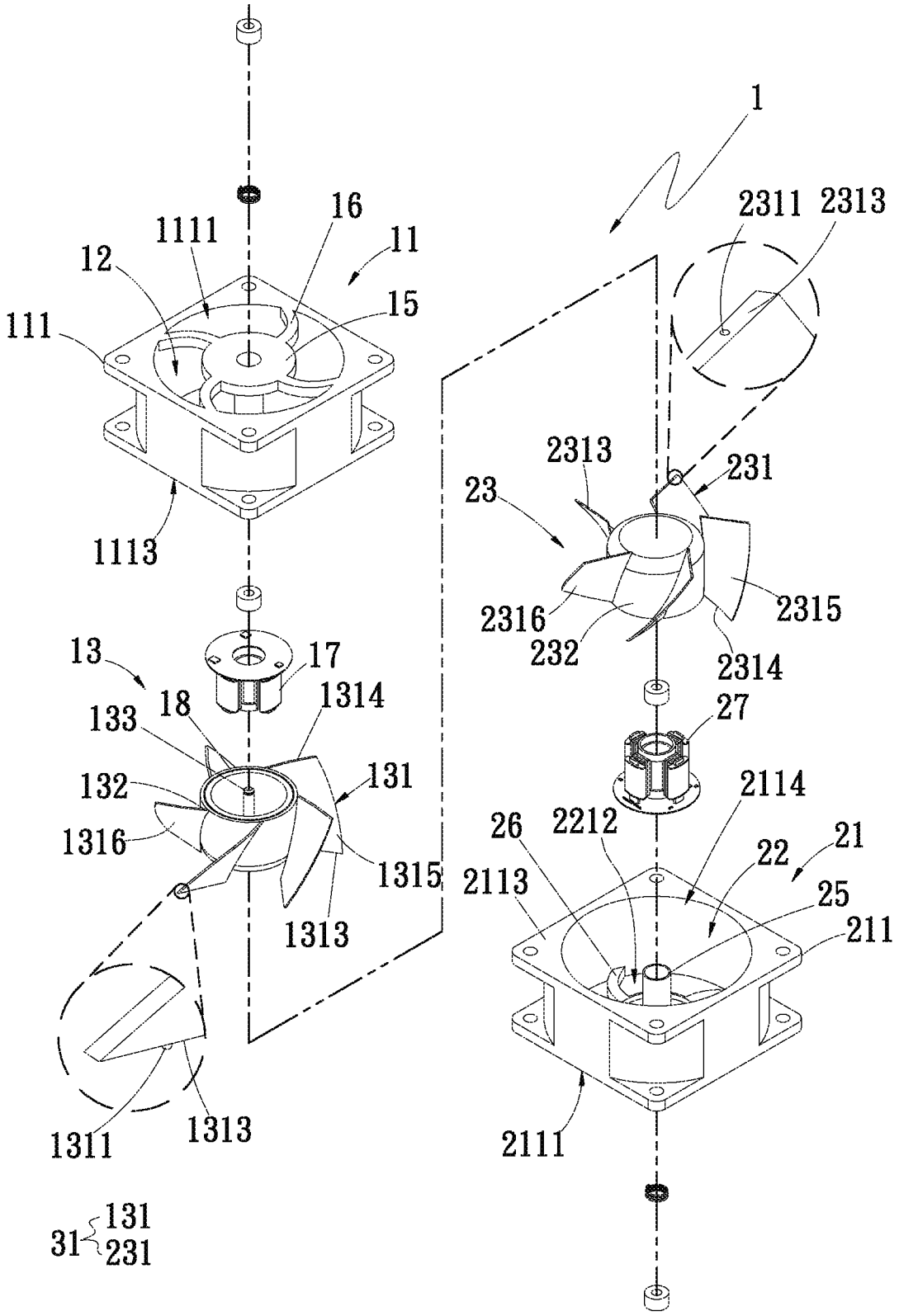
FIG. 1 is a perspective exploded view of a preferred embodiment of the present invention.
Figure 2A:
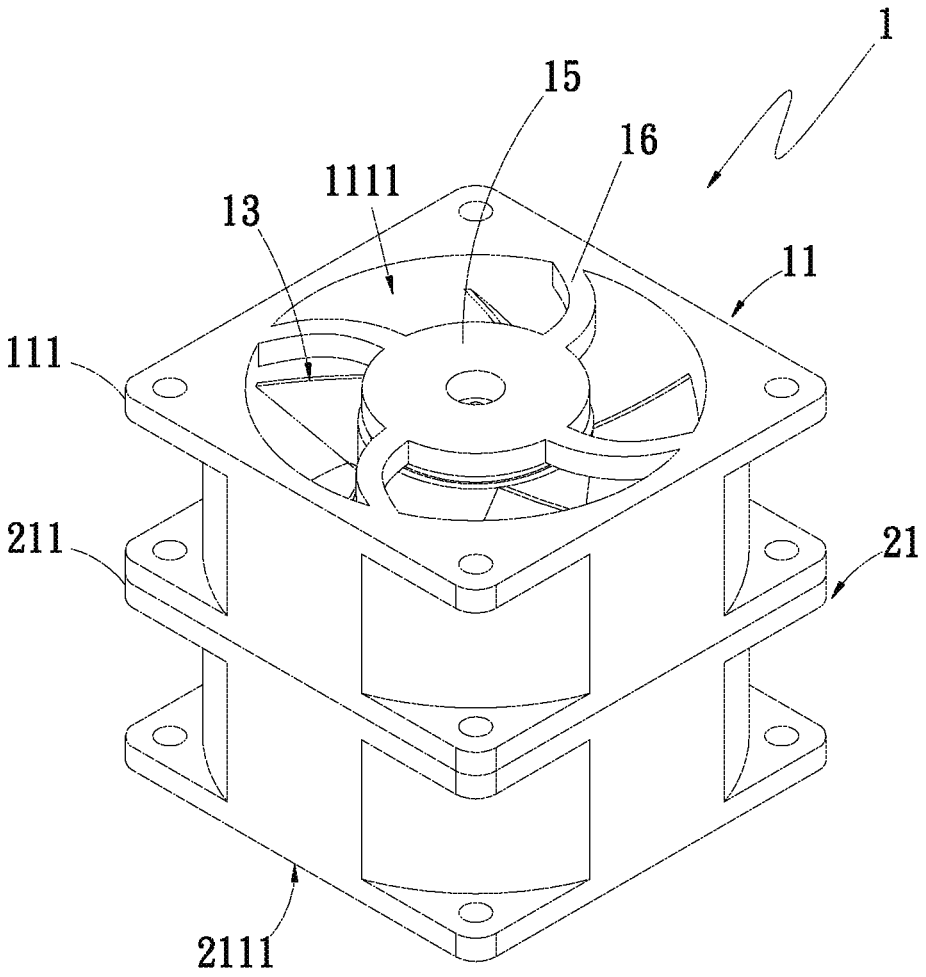
FIG. 2A is a perspective assembled view of the preferred embodiment of the present invention.
Figure 2B:
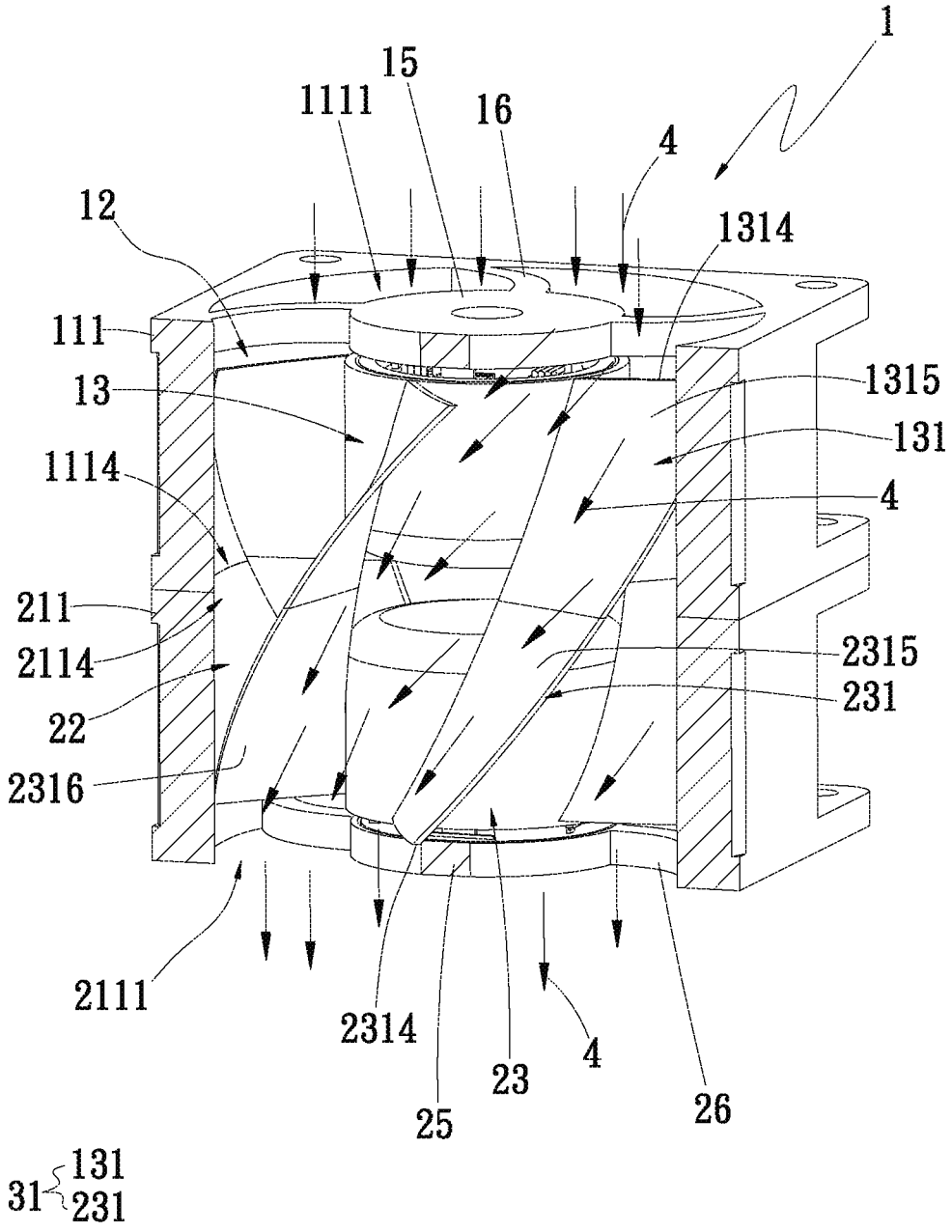
FIG. 2B is a sectional view of the preferred embodiment of the present invention, showing that the airflow is continuously pressurized by the driving blades.

Please refer to FIGS. 1, 2A and 2B. The series fan 1 of the present invention includes a first fan 11 and a second fan 21. The first fan 11 includes a first frame body 111, a first dynamic blade impeller 13 and a first shaft seat 15. Two sides of the first frame body 111 are respectively formed with a wind incoming side 1111 and a connection side 1113. The connection side 1113 has a first opening 1114. The first opening 1114 and the wind incoming side 1111 define therebetween a first flow way 12 in communication with the wind incoming side 1111 and the first opening 1114. The wind incoming side 1111 serves to guide external airflow 4 to flow into the first flow way 12 of the first frame body 111. The airflow is then guided out by the first opening 1114 to flow into the second fan 21.

The first shaft seat 15 is disposed at the center of the wind incoming side 1111. A first static blade 16 is disposed between the first shaft seat 15 and inner circumference of the first frame body 111. The first static blade 16 is positioned at the wind incoming side 1111. In this embodiment, the first static blade 16 is a rib. Two ends of the first static blade 16 are, but not limited to, respectively connected with outer circumference of the first shaft seat 15 and the inner circumference of the first frame body 111 for illustration purposes. In practice, the first static blade 16 can be a blade. The first dynamic blade impeller 13 is pivotally disposed on the first shaft seat 15 and positioned in the first flow way 12. The first dynamic blade impeller 13 has multiple first dynamic blades 131, a first hub 132, a stator 17 and a first shaft 133. One end of the first shaft 133 is fixedly disposed at the center of the first hub 132. The other end of the first shaft 133 is pivotally disposed in the first shaft seat 15. The multiple first dynamic blades 131 are radially disposed along outer circumference of the first hub 132. The stator 17 of the first dynamic blade impeller 13 is fitted around a bearing cup of the first shaft seat 15. A magnetic member 18 (such as a magnet) is disposed on inner circumference of the first hub 132. The stator 17 and the magnetic member 18 are magnetized with each other by induction.

Each first dynamic blade 131 has a blade front edge 1313, a blade tail edge 1314, a first upper surface 1315, a first lower surface 1316 and at least one connection section 1311. The blade front edge 1313 and the blade tail edge 1314 of the first dynamic blade 131 are respectively positioned in the first opening 1114 of the connection side 1113 and the wind incoming side 1111. The blade front edge 1313 can be selectively protruded from, recessed into or flush with the first opening 1114. The connection section 1311 is disposed on the blade front edge 1313 of the first dynamic blade 131.

The second fan 21 includes a second frame body 211, a second dynamic blade impeller 23 and a second shaft seat 25. Two sides of the second frame body 211 are respectively formed with a wind outgoing side 2111 and a mating side 2113. The mating side 2113 is mated with the connection side 1113 in communication therewith. The connection side 1113 of the first frame body 111 is mated with the mating side 2113 of the second frame body 211 by means of engagement, locking, insertion, adhesion, slide rail or latching, whereby the first fan 11 is upside-down placed and serially connected with the second fan 21 to form the series fan 1.

The mating side 2113 has a second opening 2114. The second opening 2114 serves to further guide the airflow flowing from the first opening 1114, whereby the airflow can continuously flow. The second opening 2114 and the wind outgoing side 2111 define therebetween a second flow way 22 in communication with the wind outgoing side 2111 and the first and second openings 1114, 2114. The first and second flow ways 12, 22 communicate with each other to together form an airflow guide passage. The wind outgoing side 2111 serves to discharge the airflow 4, which is boosted (pressurized) in the airflow guide passage so as to forcedly dissipate the heat generated by a heat generation component (such as a central processing unit or graphics processing unit).

The second shaft seat 25 is disposed at the center of the wind outgoing side 2111. A second static blade 26 is disposed between the second shaft seat 25 and inner circumference of the second frame body 211. In this embodiment, the second static blade 26 is a rib positioned at the wind outgoing side 2111. Two ends of the second static blade 26 are, but not limited to, respectively connected with outer circumference of the second shaft seat 25 and the inner circumference of the second frame body 211. In practice, the first and second static blades 16, 26 can be adjusted into same structure (such as both are ribs) or different structures (such as one is a rib, while the other is a static blade) according to the design requirement of the boosting or entire supportability of the series fan 1. The first and second static blades 16, 26 are respectively disposed in the wind incoming side 1111 and the wind outgoing side 2111 of the series fan 1 so that the supporting strength of the entire structure of the series fan 1 is effectively enhanced. Also, the vibration of the entire series fan 1 can be avoided. Moreover, the first and second static blades 16, 26 serve to shield and protect the first and second dynamic blade impellers 13, 23 so as to effectively improve the shortcoming of the conventional series fan that a protection web must be additionally arranged to cause increase of cost of material and working time.

The second dynamic blade impeller 23 is pivotally disposed on the second shaft seat 25 and positioned in the second flow way 22. The second dynamic blade impeller 23 has multiple second dynamic blades 231, a second hub 232, a stator 27 and a second shaft (not shown). One end of the second shaft is fixedly disposed at the center of the second hub 232. The other end of the second shaft is pivotally disposed in the second shaft seat 25. The stator 17 is fitted around a bearing cup of the second shaft seat 25. A magnetic member (such as a magnet, not shown) is disposed on inner circumference of the second hub 232. The stator 17 and the magnetic member are magnetized with each other by induction. The first hub 132 and the second hub 232 are upside-down arranged.

The multiple second dynamic blades 231 are radially disposed along outer circumference of the second hub 232. Each second dynamic blade 231 has a blade front edge 2313, a blade tail edge 2314, a second upper surface 2315, at least one connected section 2311 and a second lower surface 2316. The blade front edge 2313 and the blade tail edge 2314 are respectively positioned in the second opening 2114 of the mating side 2113 and the wind outgoing side 2111. The blade front edge 2313 of the second dynamic blade 231 can be selectively protruded from the second opening 2114 into the first opening 1114 or flush with (or recessed into) the second opening 2114. The connected section 2311 is disposed on the blade front edge 2313 of the second dynamic blade 231. In this embodiment, the connection section 1311 of the first dynamic blade 131 and the connected section 2311 of the second dynamic blade 231 are raised structure and recessed structure in adaptation to the raised structure for illustration purposes. That is, the connection section 1311 of the first dynamic blade 131 is a boss body, while the connected section 2311 of the second dynamic blade 231 is a dent, which is connected with the boss body. Accordingly, the connection sections 1311 of the multiple first dynamic blades 131 and the connected sections 2311 of the multiple second dynamic blades 231 are integrally connected to form multiple driving blades 31 in a continuous blade form. In addition, the first upper surface 1315 is connected with the second upper surface 2315 without any gap in the junction between the first upper surface 1315 and the second upper surface 2315 so as to form a continuous upper surface. The first lower surface 1316 is connected with the second lower surface 2316 without any gap in the junction between the first lower surface 1316 and the second lower surface 2316 so as to form a continuous lower surface.

Please refer to FIGS. 1 and 2B. When the series fan 1 operates, the first and second dynamic blade impellers 13, 23 will synchronously rotate. The multiple driving blades 31 in the continuous blade form in the airflow guide passage will guide the external airflow 4 to axially pass through the wind incoming side 1111 into the first flow way 12 of the airflow guide passage. After the airflow 4 is guided in by the blade tail edges 1314 of the first dynamic blades 131 of the multiple driving blades 31, the multiple first dynamic blades 131 will pressurize the airflow 4 to flow along the first upper surfaces 1315 in a direction to the blade front edges 1313. At this time, the pressurized airflow 4 flows to the blade front edges 1313 of the first dynamic blades 131 to further continuously flow to the second upper surface 2315, whereby the second dynamic blades 231 in the second flow way 22 further pressurizes the airflow 4. The further pressurized airflow 4 flows along the second upper surfaces 2315 in a direction to the blade tail edges 1314. Then the airflow 4 is downward thrown out (flow out) at a certain speed to pass through the second static blade 26 to outer side of the wind outgoing side 2111.

Figure 3:
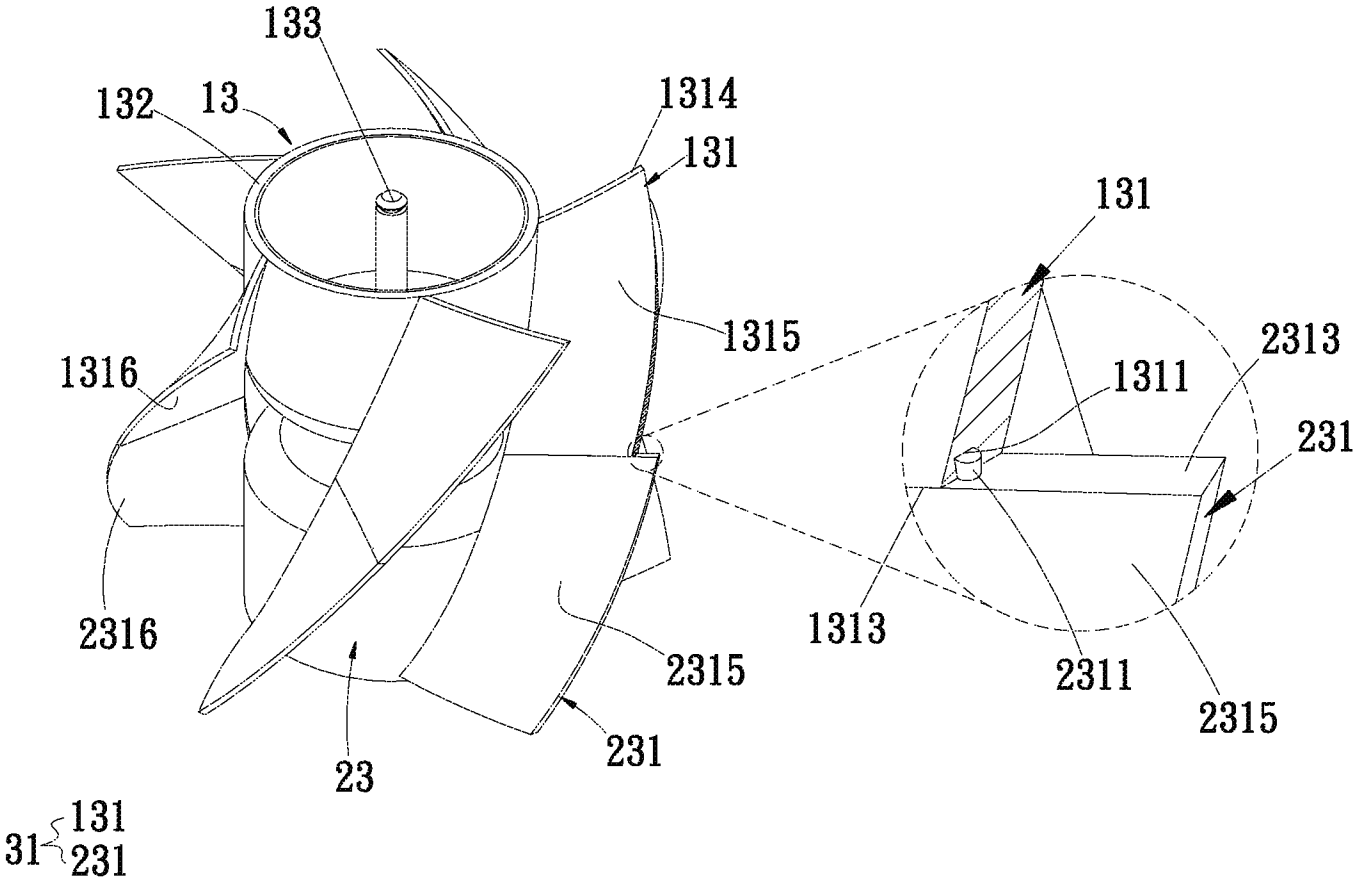
FIG. 3 is a perspective view of the preferred embodiment of the present invention, showing the connection form of the connection section and the connected section, in which the connection section and the connected section are raised structure and recessed structure in adaptation to the raised structure.

In another embodiment, the connection section 1311 and the connected section 2311 are selected from a group consisting of raised structure and recessed structure in adaptation to the raised structure (as shown in FIG. 3), screw structures, insertion structures, adhesion structures and welding structures (connected by means of welding).

In a modified embodiment, the first hub 132 of the first dynamic blade impeller 13 and the multiple first dynamic blades 131 thereon and the second hub 232 of the second dynamic blade impeller 23 and the multiple second dynamic blades 231 thereon are formed by means of integral injection molding.

According to the above design, the multiple first and second dynamic blades 131, 231 of the series fan 1 of the present invention are integrally connected to form multiple driving blades 31 in a continuous blade form.

In this case, the airflow 4 can be continuously pressurized by the first and second dynamic blades 131, 231 of the multiple driving blades 31 in the airflow guide passage so as to effectively greatly enhance the wind pressure of the entire series fan 1.

The present invention has been described with the above embodiments thereof and it is understood that many changes and modifications in such as the form or layout pattern or practicing step of the above embodiments can be carried out without departing from the scope and the spirit of the invention that is intended to be limited only by the appended claims.

What is claimed is:

1. A series fan comprising:

a first fan including a first frame body, a first dynamic blade impeller and a first shaft seat, two sides of the first frame body being respectively formed with a wind incoming side and a connection side, the first shaft seat being disposed at a center of the wind incoming side, a first static blade being disposed between the first shaft seat and inner circumference of the first frame body, the first dynamic blade impeller being pivotally disposed on the first shaft seat, the first dynamic blade impeller having multiple first dynamic blades, each first dynamic blade having at least one connection section; and a second fan including a second frame body, a second dynamic blade impeller and a second shaft seat, two sides of the second frame body being respectively formed with a wind outgoing side and a mating side, the mating side being mated with the connection side in communication therewith, the second shaft seat being disposed at a center of the wind outgoing side, a second static blade being disposed between the second shaft seat and inner circumference of the second frame body, the second dynamic blade impeller being pivotally disposed on the second shaft seat, the second dynamic blade impeller having multiple second dynamic blades, each second dynamic blade having at least one connected section, the connected section of the second dynamic blade being integrally connected with the connection section of the first dynamic blade to form a driving blade, the first fan being upside-down placed and serially connected with the second fan.

2. The series fan as claimed in claim 1, wherein the connection side has a first opening, the first dynamic blade impeller having a first hub and a first shaft, one end of the first shaft being fixedly disposed at a center of the first hub, the other end of the first shaft being pivotally disposed in the first shaft seat, the multiple first dynamic blades being radially disposed along outer circumference of the first hub, each first dynamic blade having a blade front edge and a blade tail edge, the connection section being disposed on the blade front edge, the blade front edge being protruded from, recessed into or flush with the first opening, the blade tail edge being positioned in the wind incoming side.

3. The series fan as claimed in claim 2, wherein the mating side has a second opening in communication with the first opening, the second dynamic blade impeller having a second hub and a second shaft, one end of the second shaft being fixedly disposed at a center of the second hub, the other end of the second shaft being pivotally disposed in the second shaft seat, the multiple second dynamic blades being radially disposed along outer circumference of the second hub, each second dynamic blade having a blade front edge and a blade tail edge, the connected section being disposed on the blade front edge of the second dynamic blade, the blade front edge of the second dynamic blade being protruded from the second opening into the first opening, flush with the second opening or recessed into the second opening, the blade tail edge of the second dynamic blade being positioned in the wind outgoing side.

4. The series fan as claimed in claim 1, wherein each first dynamic blade has a first upper surface and a first lower surface and each second dynamic blade has a second upper surface and a second lower surface, the first upper surface being connected with the second upper surface to form a continuous upper surface, the first lower surface being connected with the second lower surface to form a continuous lower surface.

5. The series fan as claimed in claim 1, wherein the connection section and the connected section are selected from a group consisting of raised structure and recessed structure in adaptation to the raised structure, recessed structure and raised structure in adaptation to the recessed structure, screw structures, insertion structures and adhesion structures.

6. The series fan as claimed in claim 1, wherein the connection section and the connected section are integrally connected with each other by means of welding.

7. The series fan as claimed in claim 1, wherein the connection side of the first frame body is mated with the mating side of the second frame body by means of engagement, locking, insertion, adhesion, slide rail or latching.

8. The series fan as claimed in claim 1, wherein the connection side has a first opening, a first flow way being defined between the wind incoming side and the first opening, the first flow way being in communication with the wind incoming side and the first opening.

9. The series fan as claimed in claim 8, wherein the mating side has a second opening in communication with the first opening, a second flow way being defined between the wind outgoing side and the second opening, the second flow way being in communication with the wind outgoing side and the second opening, the first and second flow ways being in communication with each other to together form an airflow guide passage, the driving blade being positioned in the airflow guide passage.

10. The series fan as claimed in claim 1, wherein the first dynamic blade impeller and the second dynamic blade impeller are formed by means of integral injection molding.

* * * * *